United States Patent [19]

Zeman et al.

[11] Patent Number: 5,063,399

[45] Date of Patent: Nov. 5, 1991

[54] ELECTROPHOTOGRAPHIC APPARATUS HAVING REDUCED DRUM DRIVE FLUTTER

[75] Inventors: Robert E. Zeman, Webster; Kevin M. Johnson, Rochester, both of N.Y.

[73] Assignee: Eastman Kodak Company, Rochester, N.Y.

[21] Appl. No.: 563,022

[22] Filed: Aug. 6, 1990

[51] Int. Cl.[5] ..... G03G 15/09

[52] U.S. Cl. ..... 346/160.1; 346/157; 355/251; 355/327; 430/122; 118/657

[58] Field of Search ..... 355/251; 118/657; 346/160, 160.1, 157; 430/122

[56] References Cited

U.S. PATENT DOCUMENTS

| | | | |
|---|---|---|---|
| 3,643,311 | 2/1972 | Knechtel et al. | 29/125 |
| 4,067,296 | 1/1978 | Sessink | 118/658 |
| 4,139,296 | 2/1979 | Ruckdeschel | 355/253 |
| 4,170,287 | 10/1979 | Edwards et al. | 198/619 |
| 4,473,029 | 9/1984 | Fritz et al. | 118/657 |
| 4,531,832 | 7/1985 | Kroll et al. | 355/253 |
| 4,546,060 | 10/1985 | Miskinis et al. | 430/108 |
| 4,550,068 | 10/1985 | Brooks et al. | 430/122 |
| 4,641,158 | 2/1987 | Takeuchi | 346/160 |
| 4,680,625 | 7/1987 | Shoji et al. | 346/157 X |

FOREIGN PATENT DOCUMENTS

| | | | |
|---|---|---|---|
| 59-229583 | 12/1984 | Japan | 355/251 |

*Primary Examiner*—Joan H. Pendegrass
*Attorney, Agent, or Firm*—Leonard W. Treash, Jr.

[57] ABSTRACT

An electrophotographic printing apparatus includes a laser or comparable image-forming apparatus which produces an image on a rotating drum having a metal core. Electrostatic images formed by the laser or the like are toned by a toning mechanism that includes a rapidly rotating magnetic core. To prevent the rapidly rotating core from producing pole transitions causing a flutter in the movement of the drum, the core has an arrangement of magnetic poles which alternate circumferentially and vary along the length of the core so that the drum is subjected to pole transistions which vary in phase along the length of the drum.

7 Claims, 3 Drawing Sheets

ELECTROPHOTOGRAPHIC APPARATUS HAVING REDUCED DRUM DRIVE FLUTTER

FIELD OF THE INVENTION

This invention relates to electrophotography and more specifically to electrophotographic apparatus in which electrostatic images are formed by scanning an electrophotosensitive drum.

BACKGROUND ART

Modern electrophotography with reusble photoconductors involves either flash, optical, scanning or electronic scanning of endless belt or drum photoconductors. Electronic scanning of photoconductive drums provides certain advantages, including ease of cross track and skew registration of color images and image enhancement advantages associated with electronic manipulation of the signal controlling the scanning operation.

As electronic exposure systems develop higher resolutions and good electrophotographic toners of extremely small size are developed, continuously higher quality multicolor and single color imaging is possible. However, as such high quality is approached, mechanical deviations from perfection are much more noticeable.

For example, any deviation in the motion of a photoconductive drum while it is being exposed by a laser or comparable exposure device can show up as an image defect. The noticeability of the defect will, of course, be much more pronounced if the overall system itself is of extremely high quality. If the system is a color system in which multiple images are combined to form a multicolor image, an error in placement of one portion of one image can show up in the final image as a noticeable change in color.

U.S. Pat. Nos. 4,546,060 to E. T. Miskinis and T. A. Jadwin; 4,473,029 to G. F. Kasper, A. S. Kroll and M. Mosehauer; and 4,531,832 to A. S. Kroll and F. A. Shuster, describe a magnetic brush development approach that can be used with extremely fine toners for highest quality imaging, for example, high quality color imaging. In this approach, a magnetic core having magnetic poles which alternate circumferentially around the core periphery is rapidly rotated in close proximity to a development zone. A non-magnetic sleeve around the core supports a developer of hard magnetic carrier particles and insulative toner. The rapid rotation of the core causes rapid pole transistions through the development zone and through portions of the outside of the sleeve leading up to the development zone. These pole transistions cause the hard magnetic carrier particles to rotate or "flip" in a direction generally causing them to move around the sleeve in a direction opposite to that of the rotating core.

This system is presently being used commercially to provide high quality color images utilizing an endless belt photoconductor.

U.S. Pat. Nos. 4,139,296; 4,170,287; 4,067,296; 4,550,068 and 3,643,311, all show cylindrical members which have magnetic poles in a helical shape around the cylinder. In general, such cylinders are used for moving magnetic particles in both the circumferential direction and in an axial direction to provide good mixing of the particles as the cylinder is rotated.

STATEMENT OF THE INVENTION

In applying the magnetic brush having a rapidly rotating core to high quality image formation using a laser or similar exposing mechanism on a hard metallic drum, an image defect showed up as substantial color banding in the image which was not present with other development systems. On analysis, it appeared that the rapid pole transitions in the development zone caused by the rapidly rotating magnetic core set up eddy currents in the metallic base of the drum. These eddy currents cause a variation in the rotation of the drum which affects the image exposed by the laser, creating the banding observed.

It is an object of the invention to reduce or eliminate the aforementioned image defect.

This and other objects are accomplished by providing a magnetic core for such a system which has an arrangement of magnetic poles which alternate circumferentially as in the prior art but also vary along the length of the core so that the drum is subjected to pole transitions which vary in phase along the length of the drum.

According to preferred embodiments of the invention the variation in the arrangement of poles along the length of the core can be continuous or abrupt and it can be random or designed. In any of these situations, the overall impact on the drum is to not stimulate a variation in the motion of the drum that results in perceptible image defects.

Although a randomly or abruptly varying arrangement of poles (along the length of the core) provides the desired effect on the drum, its implementation is difficult without causing unwanted pole transitions associated with such abrupt changes. Thus, according to a preferred embodiment of the invention, the magnetic poles are arranged in a helical pattern around the core to provide a pole variation across the length of the core without unwanted variations.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Figure 1:
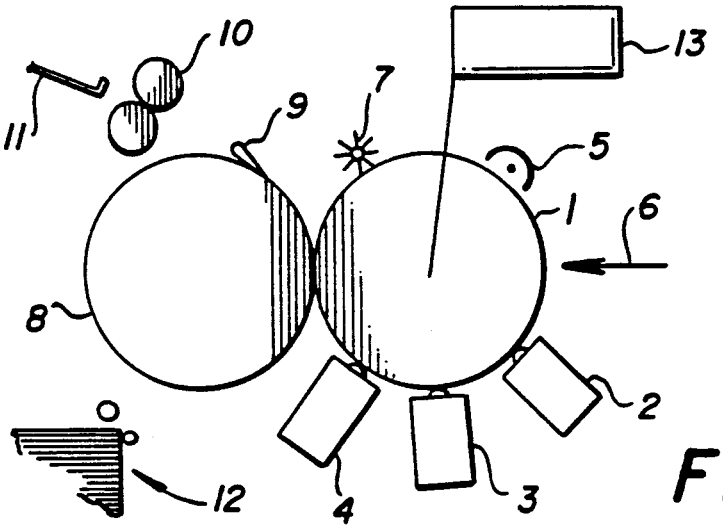
FIG. 1 is a side schematic of an electrophotographic apparatus in which the invention is particularly usable.

FIG. 1 shows an electrophotographic color apparatus in which the invention is particularly usable. According to FIG. 1, a hard metallic drum coated with conventional layers to make it electrophotosensitive is rotated by a motor 13 to bring its periphery into operative relation with a series of electrophotographic stations. The surface of the drum 1 is uniformly charged by a charging station 5, imagewise exposed at an exposing station, for example, laser exposing station 6 to create a series of electrostatic images, and toned by one of toning stations 2, 3 or 4 to create a series of toner images corresponding to image information fed to laser 6. Each image is toned with a different color toner from stations 2, 3 and 4 to create a series of different color toner images. These images are transferred in registration to a receiving sheet which has been fed from a receiving sheet supply 12 into contact with the periphery of a transfer drum 8. The receiving sheet is held on the periphery of transfer drum 8 by a means, not shown, and rotated repeatedly into transfer relation with the toner images on drum 1 to superimpose the toner images creating a multicolor image. The receiving sheet is stripped from transfer drum 8 by a stripping skive 9 and fed to a fuser 10 and finally to an output collection device 11.

Figure 2:
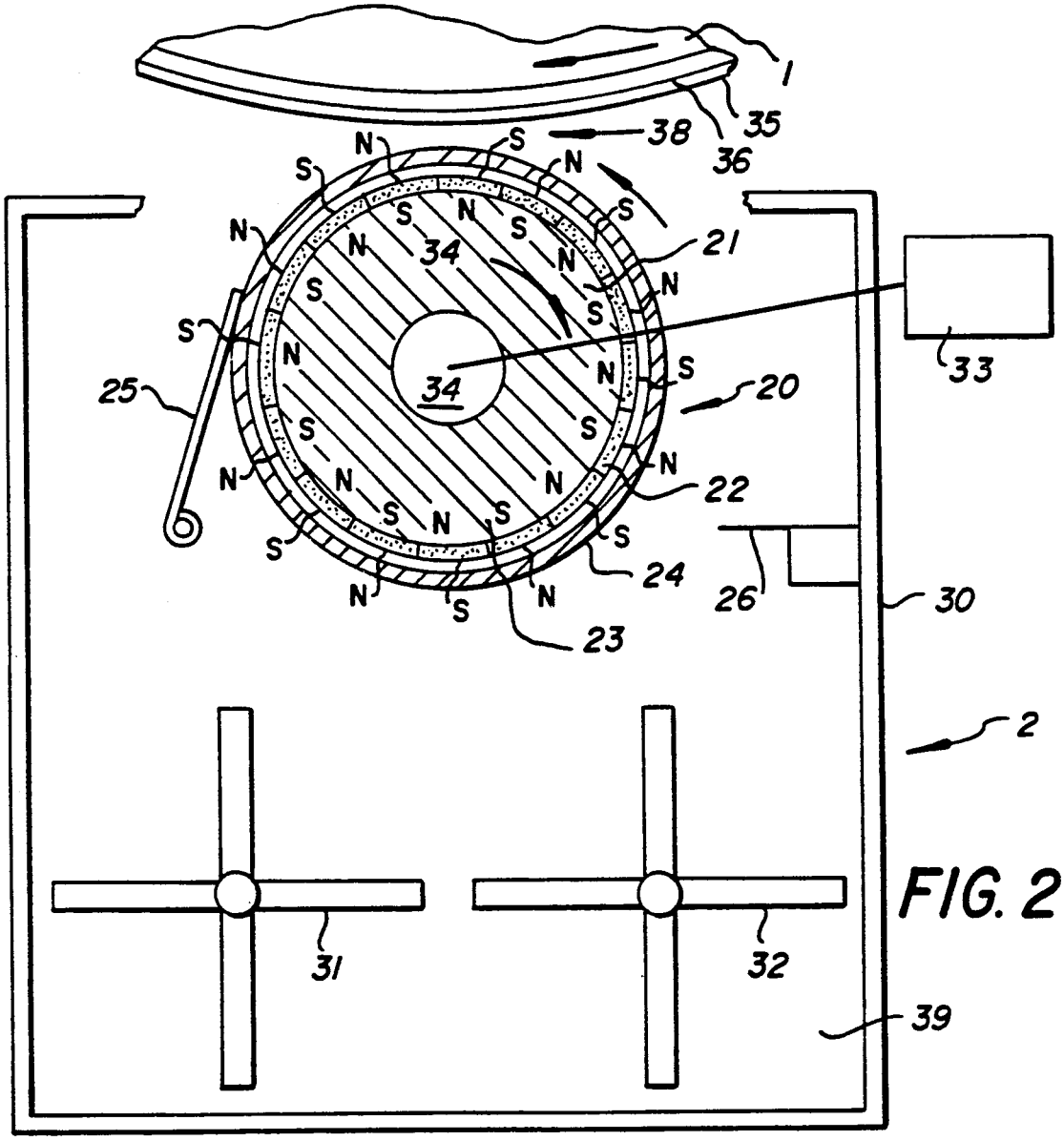
FIG. 2 is a side section, partially schematic, of a development station portion of the FIG. 1 apparatus.

For highest quality work, drum 1 has a metal core 36 (FIG. 2). This metal core provides both durability and a desirable smoothness. For highest quality work with extremely fine toners, transfer of toner images to a receiving sheet carried by transfer drum 8 is best done at relatively high pressures. These high pressures can be best obtained if drum 1 has a metal core.

FIG. 2 shows a development station 2 particularly usable in the apparatus shown in FIG. 1. Development station 2 is designed according to the teachings of previously referenced U.S. Pat. Nos. 4,546,060 to E. T. Miskinis and T. A. Jadwin; 4,473,029 to G. F. Fritz, G. P. Kasper, A. S. Kroll and M. Mosehauer; and 4,531,832 to A. S. Kroll and F. A. Shuster, which patents are incorporated by reference herein.

According to FIG. 2, a housing 30 holds a supply of 2-component developer made up of hard magnetic carrier particles and insulative toner. The hard magnetic carrier particles are permanently magnetized to a coercivity in excess of 100 gauss, preferably in excess of 1,000 gauss.

An applicator 20 is positioned in the top portion of housing 30 and includes a magnetic core 21 and a nonmagnetic sleeve 24. Magnetic core 21 includes a pole support piece 23 and a series of magnetic bars or strips 22 arranged on its periphery. The magnetic bars or strips 22 are arranged with their poles alternating as shown in FIG. 2 around the circumference of the magnetic core 21. Although FIG. 2 shows the magnetic poles on core 21 formed as separate magnetic strips 22, they can be formed out of a single element which is magnetized to provide circumferentially alternating poles.

Housing 30 is shaped to form a sump 39 for 2-component developer described above. Paddles 31 and 32 are located in sump 39 and are rotated with sufficient speed to essentially raise the level of the developer in sump 39 until it comes under the influence of core 21. Core 21 is rotated rapidly in a clockwise direction. This has the effect of flipping the hard magnetic carrier particles in a counterclockwise direction which causes the developer to move around sleeve 24 in a counterclockwise direction.

As described in the above-mentioned patents to Miskinis et al, Fritz et al, and Kroll et al, the sleeve 24 can be rotated in either direction or not rotated at all. If it is not rotated at all, it, of course, does not have to be cylindrical. As shown in FIG. 2, sleeve 24 is rotated in a direction opposite to that of core 21 and therefore assists somewhat in moving the developer. Preferably, the developer moves at substantially the same speed as the periphery of drum 1 in the development zone. Any single point in the development zone is best toned if a large number of properly charged toner particles are exposed to it. This is accomplished by exposing that point to as many pole transistions of core 21 as possible. A feed skive 26 limits the height of the developer that is being fed to the development zone 38 and a take-off skive 25 cleans developer off sleeve 24 for return to sump 39 to pick up more toner for recirculation. For more details on this process, see the above patents to Miskinis et al, Fritz et al, and Kroll et al.

As mentioned above, the rapidly rotating core 21 creates a rapidly changing magnetic field in the development zone 38. A 16-pole core rotating at 500 revolutions per minute would create 8000 pole transitions per minute to which the metallic core 36 of drum 1 is subjected. In a photoconductive drum having a metal core this creates a flutter in the drum's movement. If laser 6 is scanning at the same time, this flutter will show up as high frequency banding, which will be noticeable in a very high quality print. In a color print it will show up as color banding.

To correct this problem, we have varied the position of the poles along the length of the core 21. This variation in the poles along the length of the core varies the phase of the pole transitions affecting the drum 1 so that the drum as a whole either encounters negligible changes in overall magnetic force at any time or what changes there are occur at such a high frequency as not to cause a visible problem.

Figure 5:
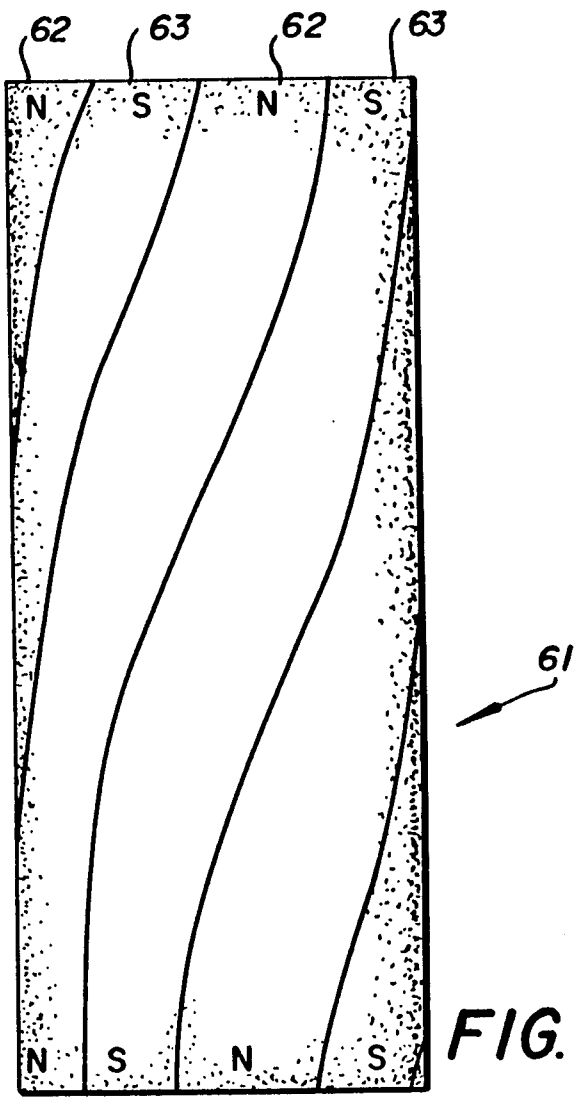
FIGS. 4 and 5 are a side section and top view respectively of an alternative core piece usable in the apparatus shown in FIG. 2.
Figure 4:
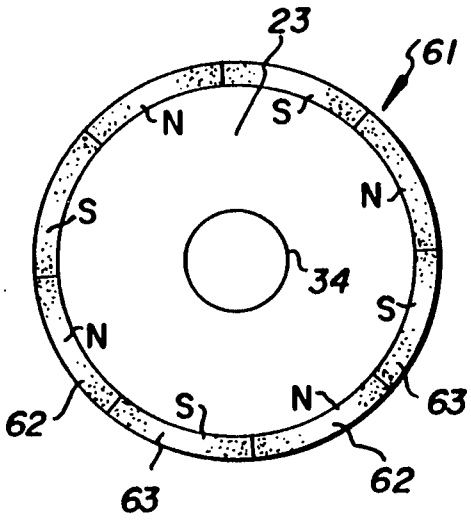
Figure 3:
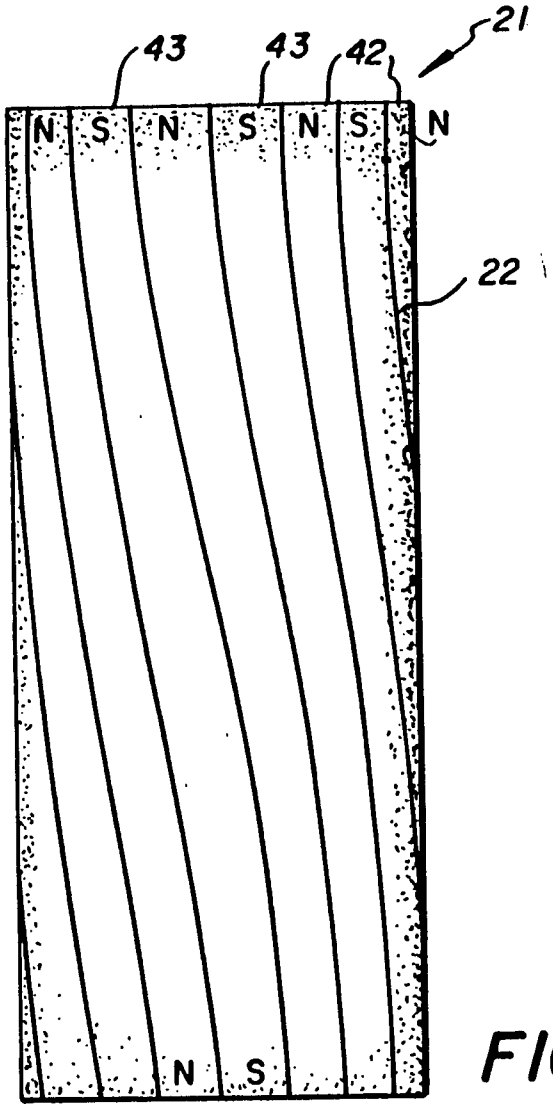
FIG. 3 is a top view of a core piece shown in section in the development station shown in FIG. 2.

This is best illustrated in FIG. 3 where a top view of core 21 shows that magnetic pole pieces 22 are made up of alternating north and south magnetic strips 42 and 43, respectively, which are positioned helically about pole support piece 23 (FIG. 2). Preferably, the helix angle is chosen such that at least one full phase of magnetic field is crossed as one travels the length of the core. With this approach, a line parallel to the axis of the drum 1 on the surface of the drum 1 would experience pole transitions of all phases at the same time which would eliminate any effect of those pole transitions on the movement of the drum. FIGS. 4 and 5 illustrate an 8-pole core 61 having north poles 62 alternating with south poles 63 and again arranged helically to produce a complete cycle of pole transitions across the length of the core 61.

Figure 6:
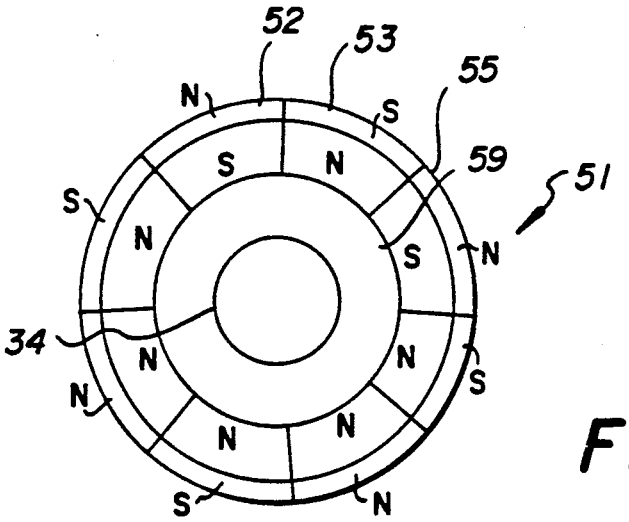
FIGS. 6 and 7 are a side section and top view respectively of another alternative core piece usable in the development station shown in FIG. 2.
Figure 7:
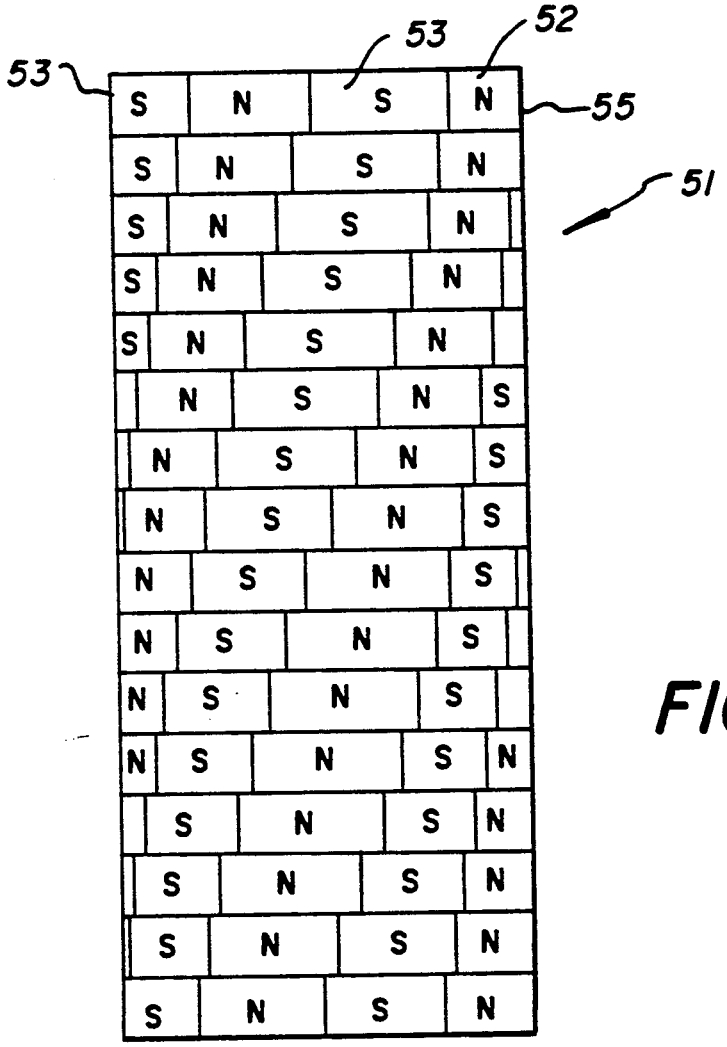

FIGS. 6 and 7 illustrate a different approach in which a core 51 is made up of a series of disks 55, each of which is made up of separate pie-shaped pole pieces secured to a pole support piece 59 which, in turn, is mounted on a shaft 34. According to FIG. 7, 16 such disks are placed on shaft 34 with each disk slightly misaligned with the disks adjacent it. This approach will accomplish the objective of not disturbing the motion of drum 1 whether the disks 55 are arranged as shown to create a helical pattern in finite steps or if the disks are arranged randomly. However, a sharp change in the phase of the pole transitions across the length of the core creates unwanted pole transitions that can show up also as artifacts in the image. Therefore, the gradual stepped phase change embodiment shown in FIG. 7 is preferred over a random orientation and the continuous helix shown in FIGS. 3 and 5 is preferred over the step change version in FIG. 7.

The helical version shown in FIGS. 3 and 5 can be made by positioning strips around a cylinder cylindrical core 23. They also may be made by helically magnetizing a single piece of magnetizable material formed to any thickness on the exterior of the core 23. This requires helically positioned electromagnetic magnetizing apparatus which is well within the skill of the art.

U.S. patent application Ser. No. 07/492,151, filed Mar. 13, 1990, to J. K. Lee et al, describes a method of making a magnetic core beginning with a neodymium-iron-boron powder dispersed in a binder and formed as a sheet. The sheet is unidirectionally magnetized between opposite surfaces and holes are drilled or punched in it. The sheet is then wrapped around and fixed to a non-magnetic cylinder. The holes create regions of opposite polarity to the surface of the sheet.

Since regions of reversed magnetic field at the holes are sharply defined, the gradient fields produced by the magnetic core are high.

This method can be used to make a core useable in this invention, preferably by arranging the holes helically around the core.

The invention has been described in detail with particular reference to a preferred embodiment thereof, but it will be understood that variations and modifications can be effected within the spirit and scope of the invention as described hereinabove and as defined in the appended claims.

We claim:

1. A printing apparatus comprising:

a rotatable metal drum having one or more layers upon which electrostatic images are formable, electronic means for forming electrostatic images on said drum, toning means for applying toner to said electrostatic images to form a toner image, said toning means including a non-magnetic sleeve, a rotatable magnetic core inside said sleeve, means for rotating said core to move a magnetic developer through a development zone on said sleeve, said magnetic core being generally cylindrical and including an arrangement of magnetic poles in which said poles alternate circumferentially and vary along the length of said core so that said metal drum is subjected to magnetic pole transitions which vary in phase along the length of said drum.

2. Apparatus according to claim 1 wherein said magnetic core has magnetic poles which are helically arranged around its periphery.

3. Apparatus according to claim 1 wherein said magnetic core is made up of a series of disks having pole pieces which alternate circumferentially, the angular orientation of the poles of the disks varying from disk to disk along the length of the core.

4. Apparatus according to claim 1 further including a plurality of toning means, each of said toning means including means for applying a different color of toner to a series of electrostatic images to create a series of different color toner images, and means for transferring said different color toner images in registration to a receiving surface to create a multicolor toner image, wherein each of said toning means includes a cylindrical magnetic core having an arrangement of magnetic poles which alternate circumferentially and vary along the length of the core so that said drum is subjected to magnetic pole transitions which vary in phase along the length of said drum.

5. Apparatus according to claim 1 wherein said electronic means for forming electrostatic images is a laser which forms said electrostatic images by line-by-line scanning of a uniformly charged surface on said drum as it is rotated past said laser.

6. A method of forming toner images on a drum having a metal base and at least an electrophotosensitive layer, said method comprising:

forming an electrostatic image on the surface of said drum by a process which includes imagewise scanning said drum, and toning said electrostatic image to form a toner image, said toning step including rotating a magnetic core within a non-magnetic sleeve to transport magnetic developer through a development zone between said sleeve and said drum, said core having an arrangement of magnetic poles which alternate circumferentially around said core and vary along the length of said core to subject the drum to magnetic pole transitions which vary in phase along the length of said drum.

7. The method according to claim 6 wherein said toning step includes transporting a magnetic developer through said development zone which developer includes hard magnetic carrier particles and insulative non-magnetic toner particles, which carrier particles flip in response to said magnetic pole transitions to move along said sleeve.

* * * * *